US005823092A

United States Patent [19]

Granberg

[11] Patent Number: 5,823,092

[45] Date of Patent: Oct. 20, 1998

[54] ROTARY ACTUATOR WITH MATING HOUSING HALVES

[75] Inventor: Rune Granberg, Älvsjö , Sweden

[73] Assignee: AB Rexroth Mecman, Stockholm, Sweden

[21] Appl. No.: 626,261

[22] Filed: Mar. 28, 1996

[30] Foreign Application Priority Data

Mar. 31, 1995 [SE] Sweden ..... 9501185

[51] Int. Cl.[6] ..... F01C 9/00

[52] U.S. Cl. ..... 92/121

[58] Field of Search ..... 92/120, 121, 122, 92/123

[56] References Cited

U.S. PATENT DOCUMENTS

| | | | |
|---|---|---|---|
| 3,139,834 | 7/1964 | Blumgren et al. . | |
| 3,613,519 | 10/1971 | Southall | 92/125 |
| 3,915,073 | 10/1975 | Burda | 92/121 |
| 4,817,504 | 4/1989 | Lieberman | 92/121 |
| 5,040,453 | 8/1991 | Eicher et al. . | |
| 5,044,257 | 9/1991 | Scobie . | |
| 5,123,333 | 6/1992 | Sollami | 92/121 |
| 5,330,333 | 7/1994 | Holmes . | |

FOREIGN PATENT DOCUMENTS

| | | |
|---|---|---|
| 0384948 | 6/1989 | European Pat. Off. . |
| 1750601 | 5/1968 | Germany . |
| 2 312 410 | 9/1973 | Germany . |
| 0224276 | 12/1965 | Sweden . |
| 1 366 628 | 9/1974 | United Kingdom . |
| 2239053 | 6/1991 | United Kingdom . |

*Primary Examiner*—F. Daniel Lopez
*Attorney, Agent, or Firm*—Townsend and Townsend and Crew LLP

[57] ABSTRACT

Rotary actuator (1) including a housing (2), which defines a working chamber (3) with at least partially circular section for actuation with a pressure fluid, a pivoting piston (5) which is sealingly arranged against the inner wall of and pivotable between two end positions in said working chamber, said housing being divided through the working chamber perpendicular to its symmetry axis. The housing (2) is divided along at least one dividing plane (A—A) and each housing portion (21) comprises recesses (12), in the surface which is defined by the dividing plane, outside and surrounding the surface of the working chamber, for cooperation with guide means (15), said recesses (12) being arranged such in the housing portions (21) that in the assembled state they are situated opposite each other so as to together form a space for receiving said guide means (15) in such a way that the guide means guide and align the housing parts (21), whereby the surface defining the dividing plane (A—A) of each housing portion (21) is produced with a manufacture tolerance between entirely plane and slightly convex, in such a way that contact between the two housing portions is safely obtained in the area of the inner wall (4), and that said surface possibly is plane face-ground at least in this area.

9 Claims, 2 Drawing Sheets

ROTARY ACTUATOR WITH MATING HOUSING HALVES

Figure 1:
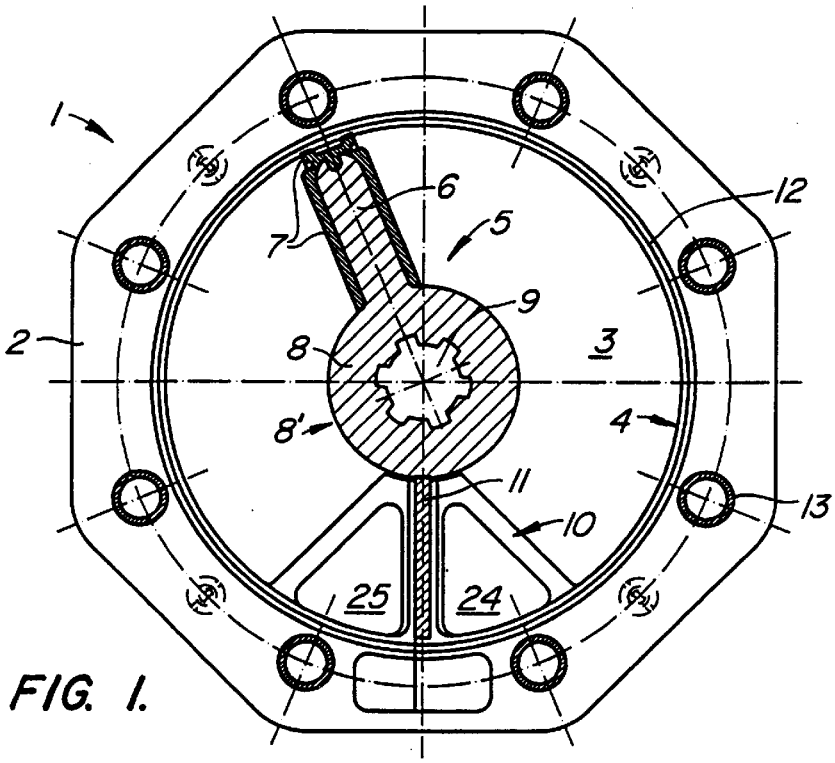

Such a rotary actuator is previously known from, as an example, GB-A-2 239 053, wherein the housing of the rotary actuator is provided with a division which is perpendicular to the axis of the rotary actuator. The division is constructed such that one of the housing halves comprises an axially extending ring shaped protrusion and the other housing half comprises a corresponding ring shaped recess adjacent to the working chamber. Threaded bolts are distributed along the periphery and tighten the parts together. In order to divide the working chamber into a high and a low pressure side, a dividing means is arranged which is inserted in position when assembling the housing.

The rotary actuator according to the known art is complicated in manufacture because of the several working steps and machining operations necessary for its production. In order to achieve a sufficiently high precision in the working chamber joint between the housing parts, it is necessary that machining is performed with a correspondingly high accuracy, all together resulting in the rotary actuator being expensive to produce.

U.S. Pat. No. 5,330,333 concerns a ring piston type rotary actuator, wherein a guide ring is arranged for aligning the housing parts. This document does not, however, discuss the particular problem with obtaining a seal between the housing parts without particular sealing arrangements.

It is an aim of this invention to eliminate the problems with rotary actuators of the kind mentioned initially and to provide a rotary actuator which can be manufactured by rational working methods and still provides good technical function.

This aim is achieved in a rotary actuator having a guide element situated in a recess of a dividing plane that is be between entirely plane and slightly convex claim.

This way it is achieved that the housing parts of the rotary actuator may be manufactured in, as an example, a simple moulding or pressure die casting process with minimal subsequent finishing. The presence of separate guiding means which are seated in the meeting surfaces in order to guide and align the housing parts make it possible to obtain high accuracy in an effective and manufacturing friendly way. By forming a dividing plane surface with a surface varying from plane to convex, it is possible to easily obtain the desired tightness. Because of the manufacturing tolerance of the dividing surface being set such that the surface is between plane or very slightly convex, contact in the area of the surface 4 is safely obtained. If necessary the surface is planed, as an example manually, whereby planing is safely obtained at the inward area of the surface. Planing may easily be made for example against a plane surface which is provided with an abrasive.

By providing a recess in the form of a circular groove it is possible to obtain desired allowance in a well adapted manner. In this respect the circular groove surrounds the chamber which is circular in section at an even distance from the working chamber wall.

A guide ring brings about safe guidance as well as simply assembly of the parts of the rotary actuator.

The use of the die cast, reinforced plastic provides a housing which is manufactured in a way that is preferred with respect to suitability as well as costs.

A divider element formed integral with a housing portion further accentuates the ease of production of the rotary actuator according to the invention, since the partition element thus does not comprise a separate but an integral unit, which besides the stop function also exercises a seal carrying function.

A series of slots in the housing brings about the obtaining of a pressure fluid inlet/outlet directly without further machining, hole drilling or the like.

Divider elements form a seat and a seal which bring about advantages in connection with assembly of the rotary actuator according to the invention.

Two similar housing parts are assembled in order to form the housing and wherein the parts are manufactured in the same mould, it is possible to achieve minimized tolerances in the manufactured parts.

Figure 2:
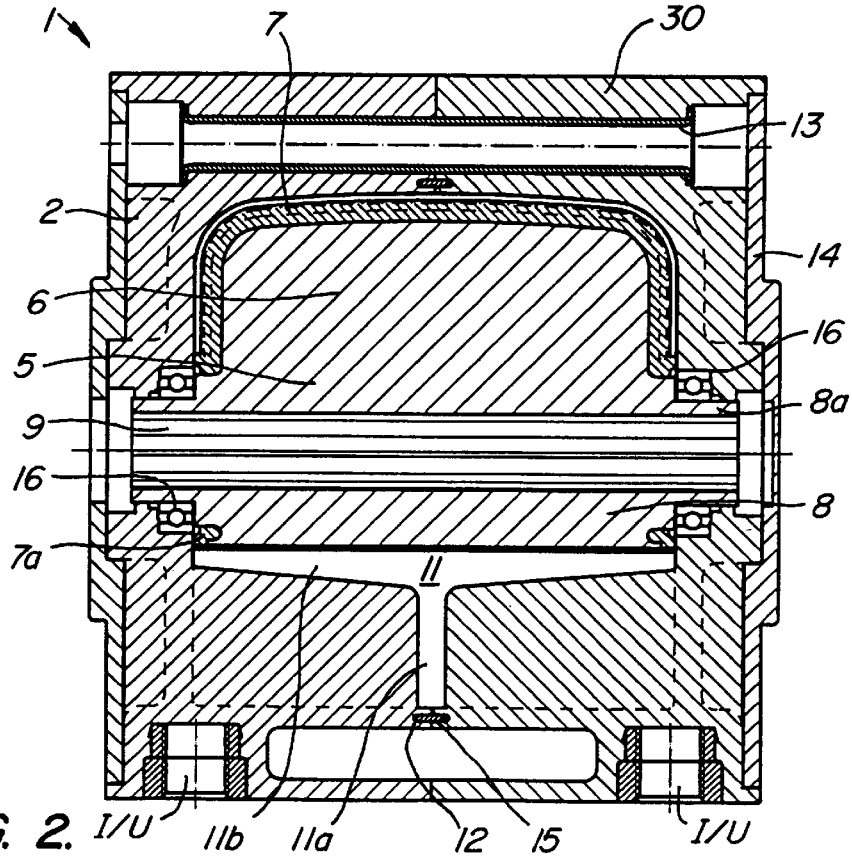
Figure 3A:
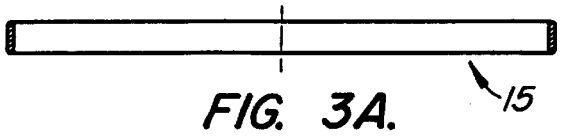
Figure 3B:
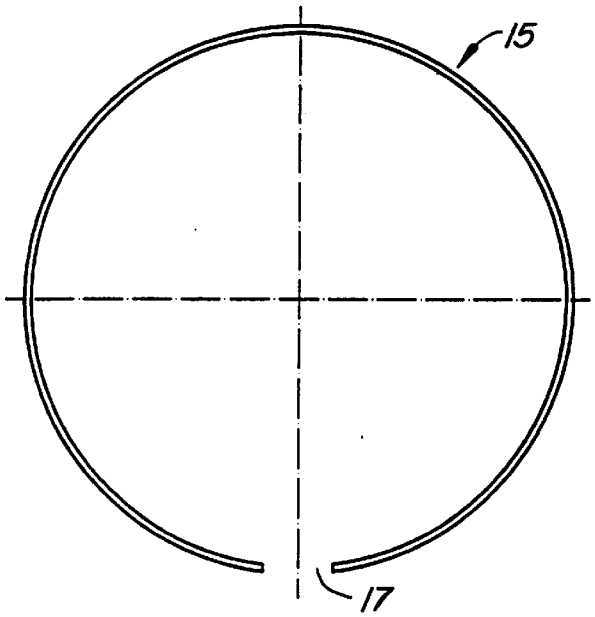
Figure 3C:
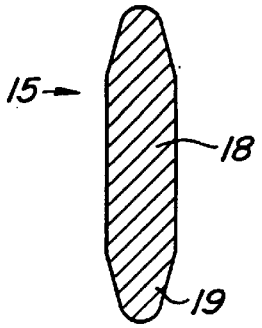
Figure 4B:
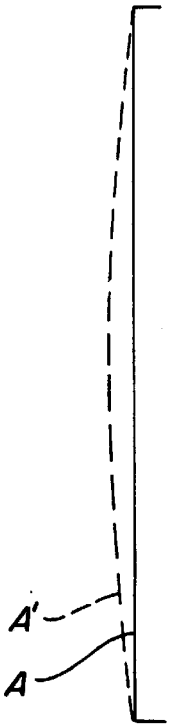
Figure 4A:
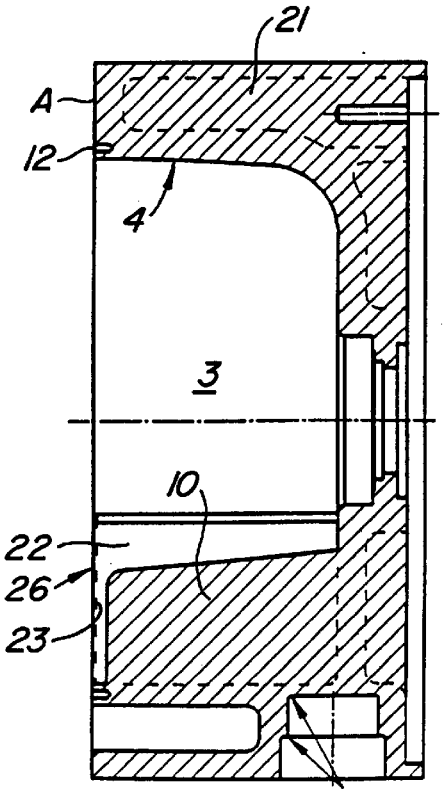

The invention will no be described in greater detail with the aid of the annexed drawings, wherein:

FIG. 1 illustrates a rotary actuator according to the invention in a section perpendicular to its axis, FIG. 2 illustrates the rotary actuator of FIG. 1 in an axial section, FIGS. 3A, 3B and 3C illustrates a guide ring in side view, plan view and ring cross-sectional view, respectively, which is used with the rotary actuator of FIG. 1 and 2, FIG. 4A illustrates a part of a housing of the rotary actuator of FIG. 1 and 2, FIG. 4B is a schematic detail of the dividing plane surface.

The rotary actuator 1 according to FIG. 1 comprises a housing 2 which defines a working chamber 3 comprising a wall 4 which is circular in section and which cooperates with a pivoting piston 5. This pivoting piston 5 as commonly comprises a wing portion 6 which seals against the wall 4 of the working chamber via a piston seal 7. Centrally the pivoting piston 5 comprises a cylindric central portion 8 and centrally therein a hole 9 for cooperation with a rotary shaft, said hole 9 inwardly being provided with rotation transmitting means, in this case so called splines.

In the lower portion of the working chamber 3 FIG. 1 shows a divider element 10 which is comprised of plate shaped portions extending from the surface 4 of the working chamber towards its central part, said plate shaped portions on the one hand being adapted to comprise the stop for the wing 6 in the end positions of the pivoting piston 5, on the other hand to support a seal element 11 for cooperation with the cylindric central portion 8 of the pivoting piston 5 in order to divide the working chamber 3 in a high and a low pressure chamber. Coaxial with the rotary axis of the pivoting piston 5 the housing 2 in the dividing plane comprises a circular guide groove (aperture) 12 at a small distance outwardly the surface 4. This guide groove 12 has a function which will be explained below. 13 depicts means for tightening the parts of the housing 2 together in an axial direction.

In FIG. 2 the rotary actuator 1 is thus shown in an axial section 30 whereby the dividing plane A—A is illustrated which is the one shown in FIG. 1.

FIG. 2 illustrates the guide groove 12 which receives the guide ring 15 whereby the cooperation of these means guide and align the housing parts in an accurate manner when the rotary actuator housing is assembled. Further a T-shaped seal element 11 is illustrated which comprises a longitudinal axial seal portion 11*b* for cooperation with the cylindric central portion 8 of the pivoting piston.

In the shown example the pivoting piston comprises bearings in the housing axially outside the working chamber, whereby pivoting piston bearings 16 having roller elements are arranged on the one hand to be received in seats for this purpose in the respective part of the housing 2 and on the other hand in a pivoting manner support the pivoting piston.

The pivoting piston comprises, as is mentioned above, a piston seal 7 for sealing against the surface of the working chamber and also a circular seal 7*a* sealing against the working chamber radially outside and surrounding said bearings 16. In FIG. 2 further is illustrated a tubular rivet 13 for axially tightening together the housing and a cover 14 on each end side of the housing.

FIGS. 3*a*, 3*b* and 3*c* illustrates the guide ring 15 in detail, said ring having a greater extension axially than radially. The ring 15 comprises an opening 17 allowing easier mounting but the ring may also be closed. In section the ring has a central portion with generally circular cylindric limiting surface and axially most outwardly two tapering, most outwardly rounded portions 19, which are directed from each other, said portions 19 facilitating entering of the ring into the guide groove in the respecting housing portion.

FIGS. 4*a* and 4*b* show the seal element seat 22 of the housing portion 21, said seat thus comprising an L-shaped groove (in the mounted position of the housing T-shaped) for receiving and holding the seal element 11 (FIG. 2) in the circumference direction. In order to obtain inlet/outlet channels to/from the working chamber 3 the divider element 10 comprises an axial extension which is reduced with respect to the extension of the housing portion in the axial direction. This reduced extension is illustrated with an interrupted line at 23 on FIG. 4A. By this construction a slot is obtained on each surface which is directed toward the working chamber 3 and which is combined by two divider elements 10 such that from/to inlet/outlet emanating pressure fluid is guided from inlet (I/U in FIG. 1) via spaces 24 and 25 (see FIG. 1) through said slot and into the working chamber and from the working chamber 3 through said slot to the outlet respectively. In order to achieve a tight joint between the spaces 24 and 25, the meeting surfaces 26 which extend radially over the element 10 have the same level as the dividing plane, and thus sealing cooperation in the assembled state of the housing. FIG. 4B shows the dividing plane surface at dividing plane A on each housing portion between entirely plane (A) and slightly convex, indicated in an exaggerated manner by the dashed line A'.

The invention may be modified at the background of the annexed claims and is only described here as an example.

The rotary actuator 1 may thus be constructed otherwise, be assembled from different housing parts 21, also in certain cases from more than two housing parts, wherein of course housing end parts, generally according to 21 as well as intermediate housing parts are used. The divider element must not necessarily be an integral divider element even if this is preferred according to the invention, it may instead be a separately inserted element. The desired guidance between the housing parts may be achieved by other means than with the illustrated guide ring 15, for example by ring parts, pins or the like placed surrounding the working chamber.

It is preferred that the rotary actuator housing according to the invention is pressure moulded in a form stable plastic material which is reinforced with a suitable reinforcing material as for example glass.

The rotary piston 15 is preferably also manufactured in a pressure moulding process in the same or a similar material as the housing. The rotary piston sealing is preferably produced integral in a further pressure die casting process in order to obtain the desired configuration. Other sealing arrangement may however, also come into question.

The tubular rivets are made of metal and brass as well as different steels may come into question. Finally it may be mentioned that the guide ring in the example preferably is manufactured from a suitable plastic material.

I claim:

1. Rotary actuator (1) comprising:

a housing (2), which defines a working chamber (3) with at least a partially circular section for actuation with a pressure fluid, the working chamber defined in part by an inner wall, said working chamber having a first end position and a second end position, the housing having a symmetry axis;

a pivoting piston (5) which is sealingly arranged against the inner wall of said working chamber and is pivotable between said first and second end positions in said working chamber;

said housing being divided through the working chamber perpendicular to its symmetry axis by at least one dividing plane (A—A) to create two housing portions with opposed, abutting dividing plane surfaces at the dividing plane;

a recess (12) in the dividing plane surface of each said housing portion surrounding the inner wall of the working chamber and situated opposite each other so as to together form a guide-receiving space;

a guide element (15) housed within the guide-receiving space to guide and align the housing portions (21);

said dividing plane surfaces are between entirely plane and slightly convex to create a sealing contact region at the abutting dividing plane surfaces in an area of the inner wall (4).

2. Rotary actuator according to claim 1, characterized in that said recess (12) is a circular groove.

3. Rotary actuator according to claim 1, characterized in that said guide element (15) is in the form of a ring.

4. Rotary actuator according to any of the claims 1, characterized in that the housing (2) is manufactured in an pressure die casting process from a form stable reinforced plastic material.

5. Rotary actuator according to claim 1, characterized in that the housing (2) is provided with at least one divider element (10) which is a continuous, one-piece extension from the respective housing portion and projects into the working chamber, said divider element constituting a stop for piston movement and a holder for an axial seal element (11) which seals against a radially inner cylindrical surface (8*a*) of the pivoting piston (5) and thereby divides the working chamber into a positive chamber and a negative chamber.

6. Rotary actuator according to claim 1, wherein the housing portions (21) comprise two singled-mold housing portions.

7. Rotary actuator according to claim 1 wherein said dividing plane surface is plane face-ground.

8. Rotary actuator (1) comprising:

a housing (2), which defines a working chamber (3) with at least a partially circular section for actuation with a pressure fluid, the working chamber defined in part by an inner wall, said working chamber having a first end position and a second end position, the housing having a symmetry axis;

a pivoting piston (5) which is sealingly arranged against the inner wall of said working chamber and is pivotable between said first and second end positions in said working chamber;

said housing being divided through the working chamber perpendicular to its symmetry axis by at least one dividing plane (A—A) to create two housing portions with opposed, abutting dividing plane surfaces at the dividing plane;

a recess (12) in the dividing plane surface of each said housing portion surrounding the inner wall of the working chamber and situated opposite each other so as to together form a guide-receiving space;

a guide element (15) housed within the guide-receiving space to guide and align the housing portions (21);

said dividing plane surfaces are between entirely plane and slightly convex to create a sealing contact region at the abutting dividing plane surfaces in an area of the inner wall (4);

said housing comprising at least one divider element (10) which is a continuous, one-piece extension from the respective housing portion and projects into the working chamber, said divider element constituting a stop for piston movement and a holder for an axial seal element (11) which seals against a radially inner cylindrical surface (8*a*) of the pivoting piston (5) and thereby divides the working chamber into a positive chamber and a negative chamber; and said divider element (10) extending over the axial longitudinal extension of the working chamber (3) in the respective housing portion but ends at a distance (at 23) inside the surface of the housing portion defined by the dividing plane (A—A) in such a way that when the housing is assembled, slots are formed outwardly in the rotational direction between the end surfaces the divider elements (10), said slots forming an inlet/outlet for pressure fluid to/from the working chamber.

9. A rotary actuator according to claim 8, characterized in the divider elements (10) in the assembled state of the housing (2) together form a seat for said axial seal element (11).

* * * * *